US008641460B2

(12) United States Patent
Koyama et al.

(10) Patent No.: US 8,641,460 B2
(45) Date of Patent: Feb. 4, 2014

(54) MOUNTING COMPONENT, ELECTRONIC DEVICE, AND MOUNTING METHOD

(75) Inventors: Jiro Koyama, Otsu (JP); Hirotada Teranishi, Kusatsu (JP)

(73) Assignee: OMRON Corporation, Kyoto-shi, Kyoto (JP)

( * ) Notice: Subject to any disclaimer, the term of this patent is extended or adjusted under 35 U.S.C. 154(b) by 0 days.

(21) Appl. No.: 13/016,084

(22) Filed: Jan. 28, 2011

(65) Prior Publication Data

US 2011/0189905 A1 Aug. 4, 2011

(30) Foreign Application Priority Data

Jan. 29, 2010 (JP) ..... 2010-018663

(51) Int. Cl.
*H01R 4/10* (2006.01)

(52) U.S. Cl.
USPC ..... 439/877; 439/862; 439/800

(58) Field of Classification Search
USPC ..... 439/877, 79, 83, 862, 630
See application file for complete search history.

(56) References Cited

U.S. PATENT DOCUMENTS

| | | | | |
|---|---|---|---|---|
| 4,808,113 | A | 2/1989 | Kanesige et al. | |
| 4,820,196 | A * | 4/1989 | Roselle et al. | 439/519 |
| 5,133,670 | A * | 7/1992 | Doi et al. | 439/79 |
| 5,746,626 | A * | 5/1998 | Kwiat et al. | 439/630 |
| 5,975,918 | A * | 11/1999 | Quillet et al. | 439/79 |
| 5,993,224 | A * | 11/1999 | Quillet et al. | 439/79 |
| 6,000,953 | A * | 12/1999 | Quillet et al. | 439/79 |
| 6,056,571 | A | 5/2000 | Noro | |
| 6,065,978 | A * | 5/2000 | Dehan et al. | 439/79 |
| 6,200,151 | B1 * | 3/2001 | Kaneko | 439/289 |
| 6,635,210 | B2 * | 10/2003 | Nilsson et al. | 264/155 |
| 6,785,127 | B1 * | 8/2004 | Monney et al. | 361/679.01 |
| 6,942,499 | B2 * | 9/2005 | Tanaka et al. | 439/76.2 |
| 6,994,576 | B2 * | 2/2006 | Tanaka et al. | 439/188 |
| 7,068,783 | B2 * | 6/2006 | Peiker | 379/446 |
| 7,357,665 | B1 * | 4/2008 | Yan | 439/500 |
| 7,374,142 | B2 * | 5/2008 | Carnevali | 248/206.5 |
| 7,431,251 | B2 * | 10/2008 | Carnevali | 248/206.5 |
| 7,575,469 | B1 * | 8/2009 | Hung | 439/500 |
| 7,646,122 | B2 * | 1/2010 | Uchiumi et al. | 310/81 |
| 7,651,381 | B2 * | 1/2010 | Chuang | 439/862 |

(Continued)

FOREIGN PATENT DOCUMENTS

| | | |
|---|---|---|
| JP | 62-092342 A | 4/1987 |
| JP | 64009376 Y | 1/1989 |

(Continued)

OTHER PUBLICATIONS

English abstract of JP62-092342 published on Apr. 27, 1987, 1 page.

(Continued)

*Primary Examiner* — Amy Cohen Johnson
*Assistant Examiner* — Vladimir Imas
(74) *Attorney, Agent, or Firm* — Osha Liang LLP

(57) ABSTRACT

A mounting component has a conductive member. The conductive member includes a press-fitting unit that is linearly extended and press-fitted in a housing, two electrode portions that are arrayed in a direction in which the press-fitting unit is press-fitted and soldered onto pads, and a connection portion that is extended in parallel with the press-fitting unit to connect the two electrode portions.

7 Claims, 3 Drawing Sheets

(56) References Cited

U.S. PATENT DOCUMENTS

| | | | | |
|---|---|---|---|---|
| 7,833,069 | B2 * | 11/2010 | Wu et al. | 439/862 |
| 7,905,731 | B2 * | 3/2011 | Ngo et al. | 439/75 |
| 7,938,697 | B2 * | 5/2011 | Inaba et al. | 439/862 |
| 7,948,694 | B2 * | 5/2011 | Bogner et al. | 359/819 |
| 2002/0003874 | A1 * | 1/2002 | Peiker | 379/419 |
| 2007/0253178 | A1 * | 11/2007 | Uchiumi et al. | 361/807 |
| 2011/0177726 | A1 * | 7/2011 | Koyama et al. | 439/839 |
| 2011/0201217 | A1 * | 8/2011 | Koyama et al. | 439/83 |

FOREIGN PATENT DOCUMENTS

| | | | |
|---|---|---|---|
| JP | 472560 | U | 6/1992 |
| JP | 10214662 | A | 8/1998 |
| JP | 10270131 | A | 10/1998 |

OTHER PUBLICATIONS

Office Action in Japanese Application No. 2010-018663, Dated: Sep. 17, 2013 (8 Pages With English Translation).

* cited by examiner

MOUNTING COMPONENT, ELECTRONIC DEVICE, AND MOUNTING METHOD

BACKGROUND OF THE INVENTION

1. Technical Field

The present invention relates to a mounting component, an electronic device, and a mounting method.

2. Related Art

A reflow method in which solder applied onto a pad of a conductor pattern is melted to electrically and mechanically connect a mounting component to the pad is widely adopted as a method for mounting the mounting component onto the conductor pattern such as a printed board. In mounting the mounting component by the reflow method, usually an electrode of the mounting component is positioned in the center of the pad of the conductor pattern by a surface tension of the melted solder.

On the other hand, because an external force acts on the mounting component such as a switch and a connector in use, the mounting component cannot be fixed with sufficient strength only by soldering the electrode of the mounting component. Therefore, in the mounting component, occasionally a dummy electrode is provided in order to physically fix the mounting component to the conductor pattern.

The mounting component, such as the switch and the connector, which is mechanically operated, is frequently configured while the conductive member or dummy electrode having an electrode portion soldered to the pad is inserted in a resin housing. In the mounting component in which the plurality of conductive members and dummy electrodes are inserted in the housing, a position in which the conductive member or dummy electrode is attached is easily varied with respect to the housing. Therefore, the mounting component cannot correctly be positioned on the conductor pattern only by the surface tension of the solder.

For example, Japanese Unexamined Patent Publication No. 62-92342 discloses a mounting structure in which a projection fitted in a hole made in a board is provided in the mounting component to fix the mounting position. In the mounting structure of Japanese Unexamined Patent Publication No. 62-92342, both shapes of the mounting component and board are complicated, which results in cost increase.

Particularly, in an electronic device in which miniaturization is required, a mounting space is enlarged when the positioning structure of Japanese Unexamined Patent Publication No. 62-92342 is provided. Therefore, desirably positioning accuracy of the mounting component is enhanced by other means.

SUMMARY

One or more embodiments of the present invention provides a high-mounting-strength mounting component that can correctly be positioned.

In accordance with one aspect of the present invention, a mounting component has a conductive member, the conductive member including a press-fitting unit that is linearly extended and press-fitted in a housing, two electrode portions that are arrayed in a direction in which the press-fitting unit is press-fitted and soldered onto pads, and a connection portion that is extended in parallel with the press-fitting unit to connect the two electrode portions.

With this configuration, because the two points of the conductive member are soldered, high joining strength is obtained even if another member is not provided for the purpose of reinforcement. Because another member is not provided, the surface tension of the solder acts only on the conductive member, and the conductive member is correctly positioned with respect to the pattern. Further, because the connection portion and the press-fitting unit are parallel to each other, when an external force is applied to the conductive member with one of electrode portions as a supporting point so as to lift up the other electrode portion, the external force can be transmitted to the housing through the press-fitting unit. Therefore, the force to lift up the electrode portions can be dispersed to enhance the mounting strength of the mounting component.

In the mounting component according to one or more embodiments of the present invention, the press-fitting unit may include a latching pawl that is located between the two electrode portions to prevent a drop from the housing.

With this configuration, because distances between the latching pawl and the electrode portions become identical to each other, the force acting on the latching pawl from the housing is dispersed into the two electrodes, but the stress is not concentrated on the one electrode. Therefore, the peel-off of the electrode from the pad can be prevented.

In the mounting component according to one or more embodiments of the present invention, the housing may include a fitting portion that is sandwiched between the press-fitting unit and the connection portion.

With this configuration, the force to lift up one of the electrode portions is transmitted to the fitting portion, and the force is dispersed to the housing, so that peel-off of the electrode portion can be prevented.

In accordance with another aspect of the present invention, there is provided an electronic device, wherein any of the mounting components described above is soldered and mounted thereon.

With this configuration, as described above, because the mounting component has the high mounting strength, the reliability of the electronic device is enhanced.

In accordance with still another aspect of the present invention, a method for mounting a mounting component includes providing a conductive member in the mounting component, the conductive member including a press-fitting unit that is linearly extended and press-fitted in a housing, two electrode portions that are arrayed in a direction in which the press-fitting unit is press-fitted, and a connection portion that is extended in parallel with the press-fitting unit to connect the two electrode portions, placing the two electrode portions on pads to which solder is applied, respectively, and melting the solder to connect the electrode portions to the pads.

With this configuration, the mounting component can rigidly be soldered without providing another member for the reinforcement, and the conductive member can correctly be positioned with respect to the pad.

DETAILED DESCRIPTION

Figure 1:
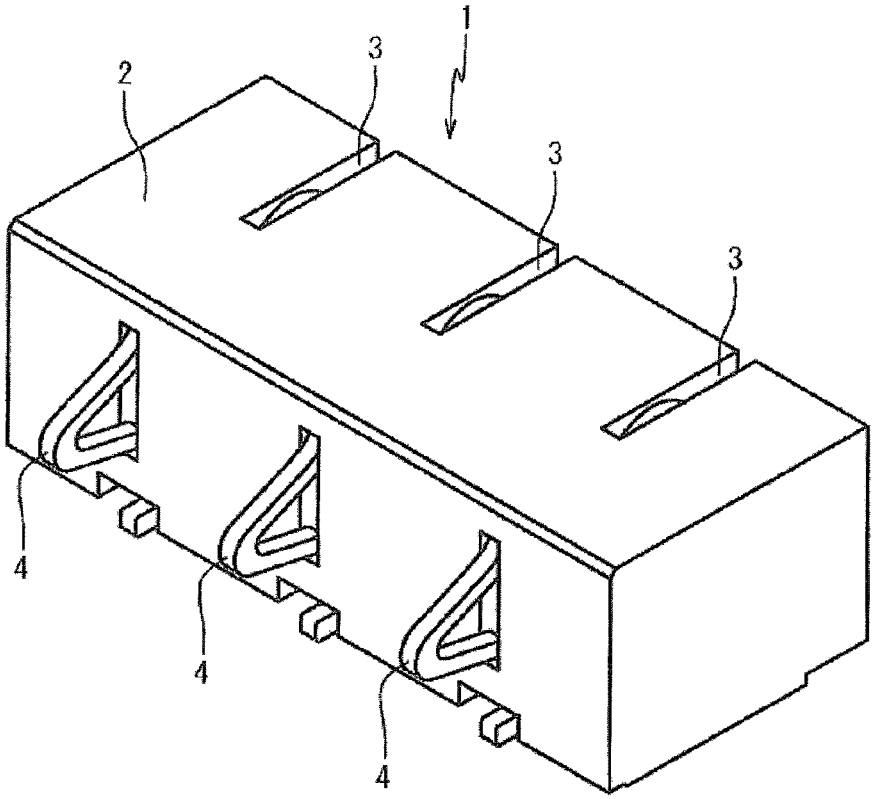
FIG. 1 is a perspective view of an electric connector according to one or more embodiments of the present invention.

Hereinafter, embodiments of the present invention will be described with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. FIG. 1 illustrates an electric connector 1 as a mounting component according to one or more embodiments of the present invention. In the electric connector 1, metallic conductive members 4 are inserted in three slots 3 formed in a housing 2, respectively.

In the three conductive members 4, the central conductive member 4 is used as a control contact, and each of the conductive members 4 located on both sides is used as a contact that gets into touch with an electrode (the-other-end electrode) of a battery in order to supply a power. When the power supplying contact is formed by a pair of contacts, reliability of electrically-conductive touch with the-other-end electrode is improved.

Figure 2:
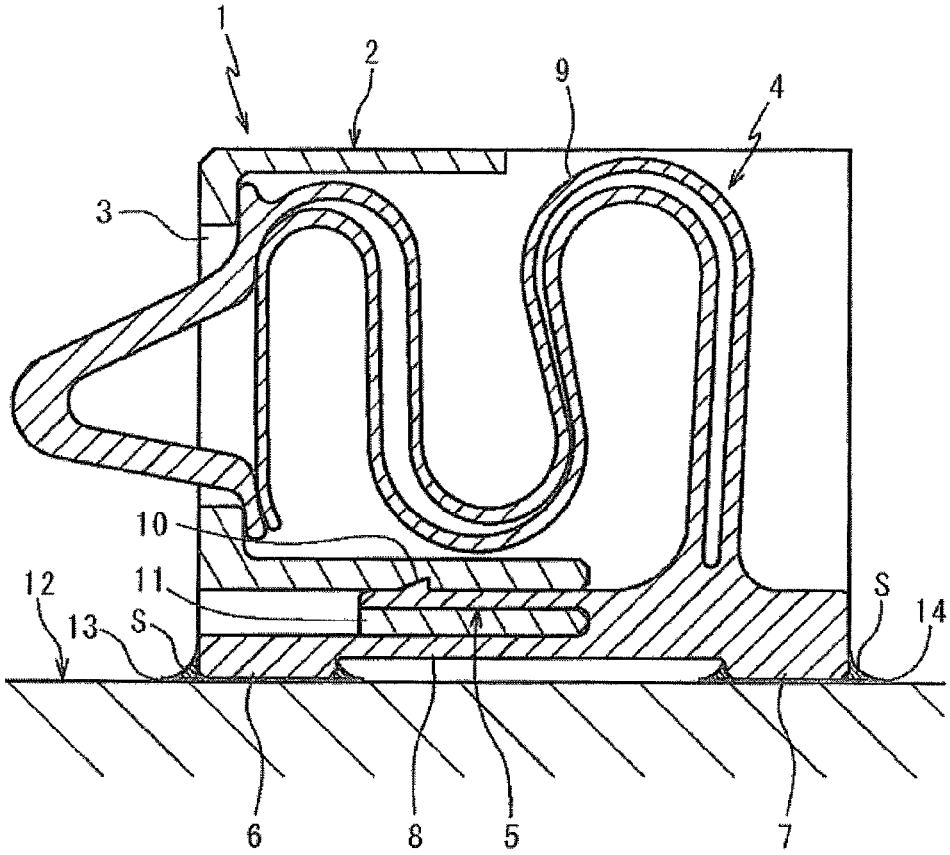
FIG. 2 is a sectional view of the electric connector of FIG. 1.

As illustrated in FIG. 2, the conductive member 4 includes a press-fitting unit 5, two electrode portions 6 and 7, a connection portion 8, and a spring portion 9. The press-fitting unit 5 is horizontally press-fitted in the housing 2. The electrode portions 6 and 7 are disposed at front and rear ends of a bottom surface of the housing 2. The connection portion 8 is extended in parallel with the press-fitting unit 5 to connect the electrode portions 6 and 7. The spring portion 9 is extended while curved such that one end of the spring portion 9 is exposed in front of the housing 2.

The electrode portions 6 and 7 are provided in parallel with the direction in which the press-fitting unit 5 is press-fitted, that is, the electrode portions 6 and 7 are horizontally arrayed so as to be able to be connected by the connection portion 8 that is extended in parallel with the press-fitting unit 5. In the press-fitting unit 5, a latching pawl 10 is formed between the electrode portions 6 and 7 in order to prevent a drop from the housing 2. The housing 2 includes a fitting portion 11 that is sandwiched between the press-fitting unit 5 and the connection portion 8.

The electric connector 1 is mounted on a circuit pattern of a printed board 12 by reflow of solder S. Particularly, cream solder S is applied to each of pads 13 and 14 formed in the printed board 12. While the electrode portions 6 and 7 are place on the pads 13 and 14, the cream solder S is heated and melted (reflow), and the electrode portions 6 and 7 are joined and fixed to the pads 13 and 14 by the cream solder S. At this point, a surface tension of the melted cream solder S acts on the electrode portions 6 and 7 such that the electrode portions 6 and 7 are moved to centers of the corresponding pads 13 and 14.

The electrode portion 6 is projected downward from the connection portion 8, and the electrode portion 6 is also projected downward from the housing 2. Therefore, in the electric connector 1, only the electrode portions 6 and 7 of the conductive member 4 are fixed to the pads 13 and 14 of the printed board 12, respectively.

In one or more embodiments of the present invention, one of the pads 13 and 14 may be a dummy pad that is electrically isolated from a circuit on the printed board 12 to exert only a function of mechanically retaining the corresponding electrode portion 6 or 7.

In the electric connector 1, the-other-end electrode is press-bonded to a leading end of the spring portion 9, and the-other-end electrode is connected to the pads 13 and 14 formed in the circuit of the printed board 12 through the electrode portions 6 and 7. At this point, a pressing force of the-other-end electrode acts as moment of a force such that the front-side electrode 6 is lifted up through the spring portion 9 while the rear-side electrode 7 is used as a supporting point.

The force is transmitted to the housing 2 through the press-fitting unit 5 and the connection portion 8. The moment of the force to lift up one of the electrodes 6 and 7 with the other of the electrodes 6 and 7 as the supporting point acts on in perpendicular to the extended directions of the press-fitting unit 5 and connection portion 8, so that the force can efficiently be transmitted from the conductive member 4 to the housing 2. The force transmitted to the housing 2 acts so as to turn the press-fitting units 5 of the two remaining conductive members 4. That is, the force acting on one conductive member 4 is dispersed to other conductive members 4 through the housing 2. Accordingly, the external force acts evenly on the three conductive members 4 to prevent the peel-off of the electrode portion 6 or 7 of one conductive member 4 from the pad 13 or 14. The peel-off of the electrode portion 6 or 7 of one conductive member 4 from the pad 13 or 14 is generated by the concentration of the external force only on the electrode portion 6 or 7 of one conductive member 4.

Because the electrode portions 6 and 7 are connected and integrated by the connection portion 8, a positional relationship between the electrode portions 6 and 7 is kept constant and accurate. Even if the position in which the conductive member 4 is attached is deviated with respect to the housing 2, because the conductive member 4 is correctly positioned with respect to the printed board 12 by the reflow of the cream solder S, the position of the spring portion 9 is not deviated with respect to the-other-end electrode. Therefore, the spring portion 9 can exert the contact pressure as designed with respect to the-other-end electrode.

In one or more embodiments of the present invention, the latching pawl 10 is provided in the press-fitting unit 5. Therefore, the force that acts horizontally on the housing 2 is transmitted to the press-fitting unit 5 through the latching pawl 10. Because the latching pawl 10 is located between the electrode portions 6 and 7, the latching pawl 10 does not excessively apply to any one of the electrode portions 6 and 7 with respect to the external force in any direction, and the electrode portions 6 and 7 are hardly peeled off from the pads 13 and 14.

Figure 3:
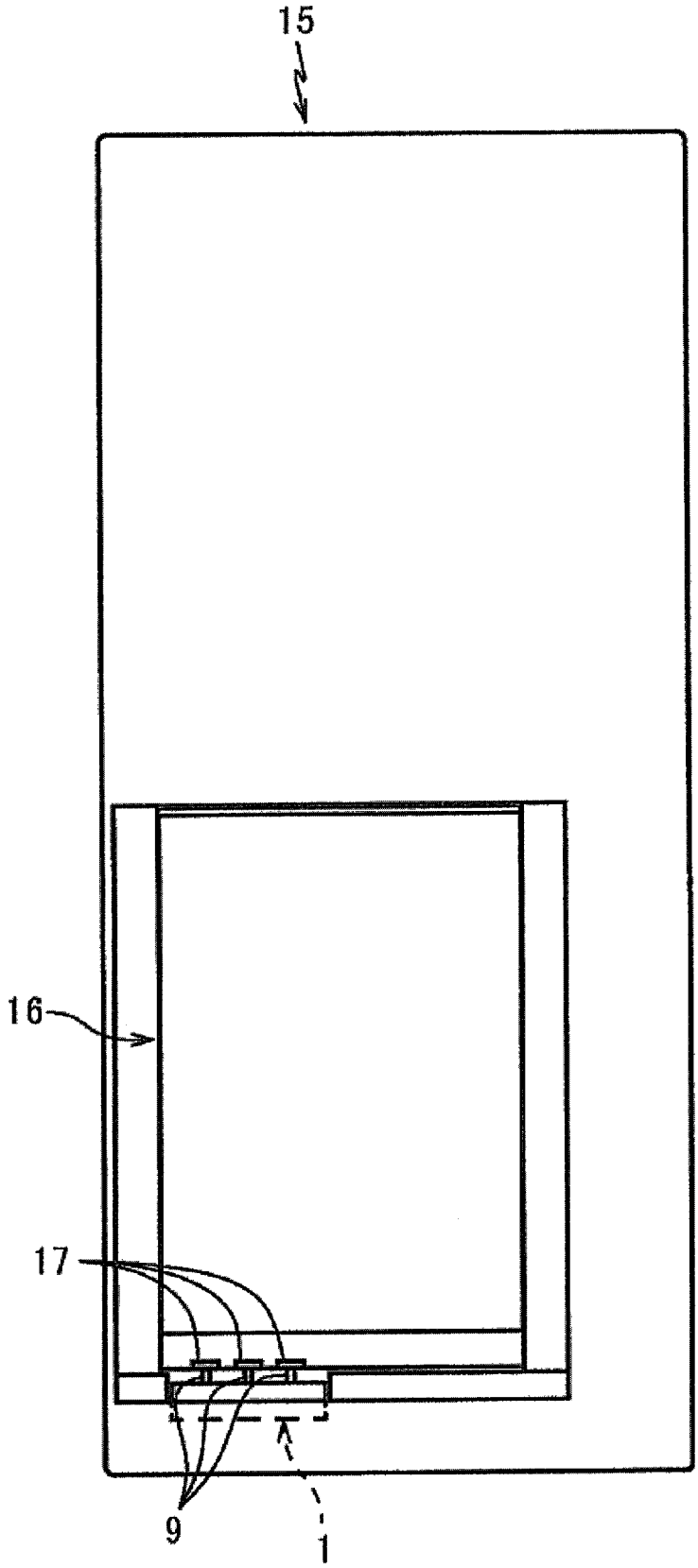
FIG. 3 is a rear view of a mobile telephone according to one or more embodiments of the present invention on which the electric connector of FIG. 1 is mounted.

FIG. 3 illustrates a mobile telephone 15 as the electronic device according to an embodiment of the present invention provided with the electric connector 1 of one or more embodiments of the present invention. In the mobile telephone 15, the electric connector 1 is provided, and a battery 16 can be accommodated in a space adjacent to the electric connector 1. When the battery 16 is accommodated in the mobile telephone 15, the leading end of the spring portion 9 of the electric connector 1 gets into pressure touch with an electrode 17 of the battery 16.

As described above, because the electric connector 1 has the high mounting strength to the printed board 12, even if the contact pressure is increased, the conduction failure caused by the peel-off of the solder S is hardly generated, and the contact reliability is increased. Therefore, the electric power is always supplied from the battery 16 to the mobile telephone 15, so that standby processing and the like can securely be performed.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A mounting component comprising a conductive member, the conductive member including:

a press-fitting unit that is linearly extended in a front-back direction and press-fitted in a housing;

two electrode portions that are arrayed in the front-back direction in which the press-fitting unit is press-fitted and soldered onto pads on a printed board surface;

a connection portion that is extended in parallel with the press-fitting unit to connect the two electrode portions; and a spring portion that extends while curved, wherein one end of the spring portion is exposed in front of the housing so as to be configured to receive an other-end electrode that is press-bonded thereto in a press-bonding direction, and wherein the press-bonding direction is parallel to the printed board surface.

2. The mounting component according to claim 1, wherein the press-fitting unit includes a latching pawl that is located between the two electrode portions to prevent a drop from the housing.

3. The mounting component according to claim 1, wherein the housing includes a fitting portion that is sandwiched between the press-fitting unit and the connection portion.

4. An electronic device, wherein the mounting component according to claim 1 is mounted thereon.

5. A mounting method comprising:

providing a conductive member in a mounting component, the conductive member including a press-fitting unit that is linearly extended in a front-back direction and press-fitted in a housing, two electrode portions that are arrayed in the front-back direction in which the press-fitting unit is press-fitted, and a connection portion that is extended in parallel with the press-fitting unit to connect the two electrode portions;

placing the two electrode portions on pads to which solder is applied, respectively; and melting the solder to connect the electrode portions to the pads on a printed board surface, wherein the conductive member further comprises a spring portion that extends while curved, wherein one end of the spring portion is exposed in front of the housing so as to be configured to receive an other-end electrode that is press-bonded thereto in a press-bonding direction, and wherein the press-bonding direction is parallel to the printed board surface.

6. The mounting component according to claim 1, wherein the press-fitting unit and the connection portion that are disposed vertically apart from each other.

7. The mounting method according to claim 5, wherein the press-fitting unit and the connection portion that are disposed vertically apart from each other.

* * * * *